United States Patent [19]

Webster et al.

[11] Patent Number: 4,608,574

[45] Date of Patent: Aug. 26, 1986

[54] BACKFIRE BIFILAR HELIX ANTENNA

[75] Inventors: Carson W. Webster, Sykesville; Robert K. Stilwell, Columbia, both of Md.

[73] Assignee: The United States of America as represented by the Secretary of the Air Force, Washington, D.C.

[21] Appl. No.: 611,060

[22] Filed: May 16, 1984

[51] Int. Cl.[4] ..... H01Q 1/36

[52] U.S. Cl. ..... 343/895

[58] Field of Search ..... 343/895, 908

[56] References Cited

U.S. PATENT DOCUMENTS

| | | | |
|---|---|---|---|
| 3,564,553 | 2/1971 | Leonard | 343/792.5 |
| 3,599,220 | 8/1971 | Dempsey | 343/895 |
| 3,757,345 | 9/1973 | Carver | 343/786 |
| 4,008,479 | 2/1977 | Smith | 343/895 |
| 4,011,567 | 3/1977 | Ben-Dov | 343/853 |
| 4,014,028 | 3/1977 | Cone et al. | 343/895 |

OTHER PUBLICATIONS

Junji Yamauchi, Hisamatsu Nakano and Hiroaki Mimaki, Backfire Bifilar Helical Antenna with Tapered Feed End, IEEE International Symposium on Antennas and Propagation (1981) pp. 683–686.

C. C. Kilgus, Resonant Quadrifilar Helix Design, The Microwave Journal (Dec. 1970) pp. 49–54.

John D. Kraus, A 50-Ohm Input Impedance for Helical Beam Antennas, IEEE Transactions on Antennas and Propagation, vol. AP-25, No. 6 (Nov. 1977) p. 913.

Willard T. Patton, A Backfire Bifilar Helical Antenna, Antenna Laboratory Technical Report, No. 61, (Sep. 1962) AD 289084.

*Primary Examiner*—Eli Lieberman

*Attorney, Agent, or Firm*—Donald J. Singer; Thomas L. Kundert

[57] ABSTRACT

A backfire bifilar helix antenna is disclosed having two helically wound conductors made of coaxial cable wherein the two conductors comprise the shield portion of the cable. The coaxial cable of one of the conductors serves as a transmission line for supplying signals to the feed end of the antenna and has its center conductor connected to the shield of the other conductor cable. The nominal input impedance of the antenna may be adjusted to a desired value by conductive surface layers attached to the shield portion of the conductors at the feed end.

8 Claims, 5 Drawing Figures

BACKFIRE BIFILAR HELIX ANTENNA

RIGHTS OF THE GOVERNMENT

The invention described herein may be manufactured and used by or for the Government of the United States for all governmental purposes without the payment of any royalty.

BACKGROUND OF THE INVENTION

The present invention relates to electrical antennas and particularly to an improved backfire bifilar helical antenna.

The backfire bifilar helical antenna is a circularly polarized antenna having two opposed helical wires fed at one end with balanced currents. When operated above the cutoff frequency of the helical waveguide, the bifilar helix produces a beam directed along the structure toward the feed point. The term "backfire" is used to describe this direction of radiation in contrast with "endfire" which denotes radiation away from the feedpoint. A detailed study of the antenna appears in a report by Willard T. Patton dated September, 1962 which is available from the Defense Technical Information Center (DTIC), Alexandria VA under catalog number AD 289084.

An example of a backfire bifilar helical antenna is shown in U.S. Pat. No. 4,014,028 to John A. Cone et al. The antenna consists of two interlaced helixes fed at one end. Each helix is fed with energy of equal amplitude and 180° out of phase by a transmission line comprising, for example, a double quarterwavelength slot balun. Optionally the helixes may be connected to a ground plane at the other end for mechanical stability and an insulating right cylinder may be used to support the helixes. The two helixes have a diameter and a pitch to provide a backward wave structure. The direction of energy flow is away from the feed end but the direction of phase progression is toward the feed end.

The bifilar helix is relatively simple when compared to other types of antennas with similar performance. It has an advantage over the conventional axial mode (single element) helix in that the two elements are fed in a balanced mode and do not require a ground plane. The axial mode helix is useful in applications where narrow beamwidth, moderate gain is needed. The backfire bifilar helix can be used in these situations, and in addition, by adjusting the geometry of the helix, it can also be made to supply a wide beam with lower gain for such applications as satellites and ground stations.

A helical beam antenna having a uniform conductor has a nominal impedance which is not convenient for certain applications. John D. Kraus reported in IEEE Transactions on Antennas and Propagation, VOL AP-25, No. 6, November, 1977, pg. 913, that the nominal impedance of an axial fed helix (single element) of uniform conductor size may be adjusted by increasing the conductor size close to the feed point at the ground plane. This lowers the characteristic impedance of the conductor-ground plane combination (acting as a transmission line) and transforms the helix impedance to a lower value over a substantial bandwidth. The teaching of Kraus is directed to an axial mode helix fed against a ground plane and requires that the spacing between the conductor and the ground plane be adjusted to achieve the desired impedance.

In the case of the bifilar helix, two elements are fed in a balanced mode and no ground plane is required. In view of the potential disadvantage caused by poor input impedance, it would be desirable to provide a backfire bifilar helix antenna capable of providing a good impedance match over a broad band of operating frequencies. What would especially be desirable is to design a backfire bifilar helix antenna having a predetermined input impedance which could be manufactured on a production basis without need for adjustment and costly individual fine tuning. In addition it would also be desirable to provide a backfire bifilar helix antenna having a simplified feed arrangement that avoids the complexities of conventional folded and split shield baluns.

SUMMARY OF THE INVENTION

It is therefore an object of the invention to provide a backfire bifilar helix antenna having an input impedance that can be adjusted over a broad band of frequencies.

It is another object of the invention to provide a backfire bifilar helix antenna having a simple infinite balun feed means for coupling signals of equal magnitude and 180° out of phase to one end of the antenna.

It is yet another object of the invention to provide a backfire bifilar helix antenna having two helically wound conductors made of coaxial cable, wherein the two conductors comprise the shield portions of the coaxial cables, and wherein one of the coaxial cable conductors serves as a feed cable and has its center conductor connected to the shield of the other helical conductor.

The backfire bifilar helix antenna according to the invention may be used for radiating or receiving circularly polarized waves. The antenna comprises first and second conductors helically wound in the same direction. The helixes are preferably made of lengths of coaxial cable with the first and second conductors comprising the shield portion of the coaxial cable. An infinite balun feed arrangement is used for coupling signals of equal magnitude and 180° out of phase to one end of the first and second conductors. The coaxial cable of one of the conductors serves as a transmission line for supplying signals and has its center conductor connected to the shield of the second conductor coaxial cable at the feed end.

The first and second conductors are preferably wound on a tubular member to insure a predetermined radius and pitch for optimum backfire mode operation. Input impedance is controlled by conductive surface layers connected to the feed ends of the first and second conductors. In the preferred embodiment, the conductor surface layers are disposed on a disk attached to an end of the tubular member. The disk is made of an insulative material covered with a thin conductive cladding. The cladding is trimmed or etched into two identical opposing conductive surface layer patterns to which the ends of the first and second conductors are connected.

Other features and advantages of the invention will be apparent from the following description and claims, and are illustrated in the accompanying drawings which show an embodiment of the invention.

DETAILED DESCRIPTION

Figure 1:
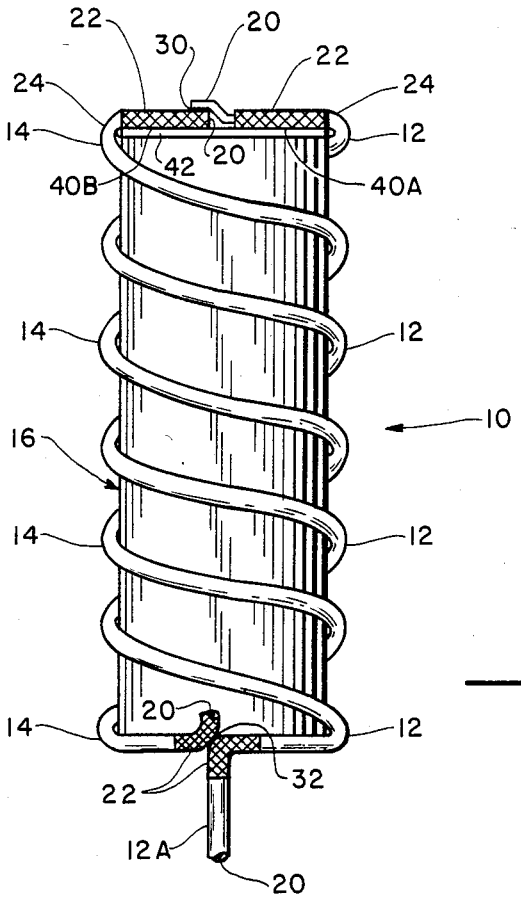
FIG. 1 is a side view showing the backfire bifilar helix antenna according to the invention.

FIG. 1 illustrates an improved backfire bifilar helix antenna according to the preferred embodiment of the invention. The antenna is generally indicated at 10 and includes two interlaced helixes 12 and 14 wound in the same direction on a tubular member 16. The helixes are made of a suitable wire conductor, and for purposes of the present invention are preferably made of individual lengths of coaxial cable such as commercially available RG 316 50 ohm cable having a center conductor 20 and a conductive shield 22. The center conductor 20 is surrounded by and separated from the shield 22 by dielectric material (not shown). Shield 22 may be covered by a thin layer of insulative material as indicated at 24.

The operation of the antenna 10 will be generally described in terms of the radiation or transmission of circularly polarized waves, however, it will be understood that the antenna works equally well for the reception of such waves.

Signals to be transmitted by antenna 10 are communicated to the feed end of the helixes located at the top of the tubular member 16, by helix 12 which also serves as a feed cable. As is known in the art, the center conductor 20 and shield 22 of the helix 12 may be used to provide a coaxial transmission line for the communication of signals from a signal source. The currents on the center conductor and shield have equal magnitude and are 180° out of phase. At the top of the tubular member 16, helix 12 terminates and has its center conductor 20 connected by means of solder 30 or the like to the shield 22 at the end of helix 14. The center conductor 20 of helix 14 is not used.

Using helix 12 is a transmission line and connecting the center conductor 20 of helix 12 thereof to the shield 22 of helix 14 provides an infinite balun feed arrangement for the bifilar helix. The shield 22 of helix 14 will thus be fed with a signal having equal magnitude and 180° out of phase with the signal on the shield 22 of helix 12. The feed arrangement is very simple and is equivalent to a voltage generator connected directly across the feed ends of helixes 12 and 14.

Figure 2:
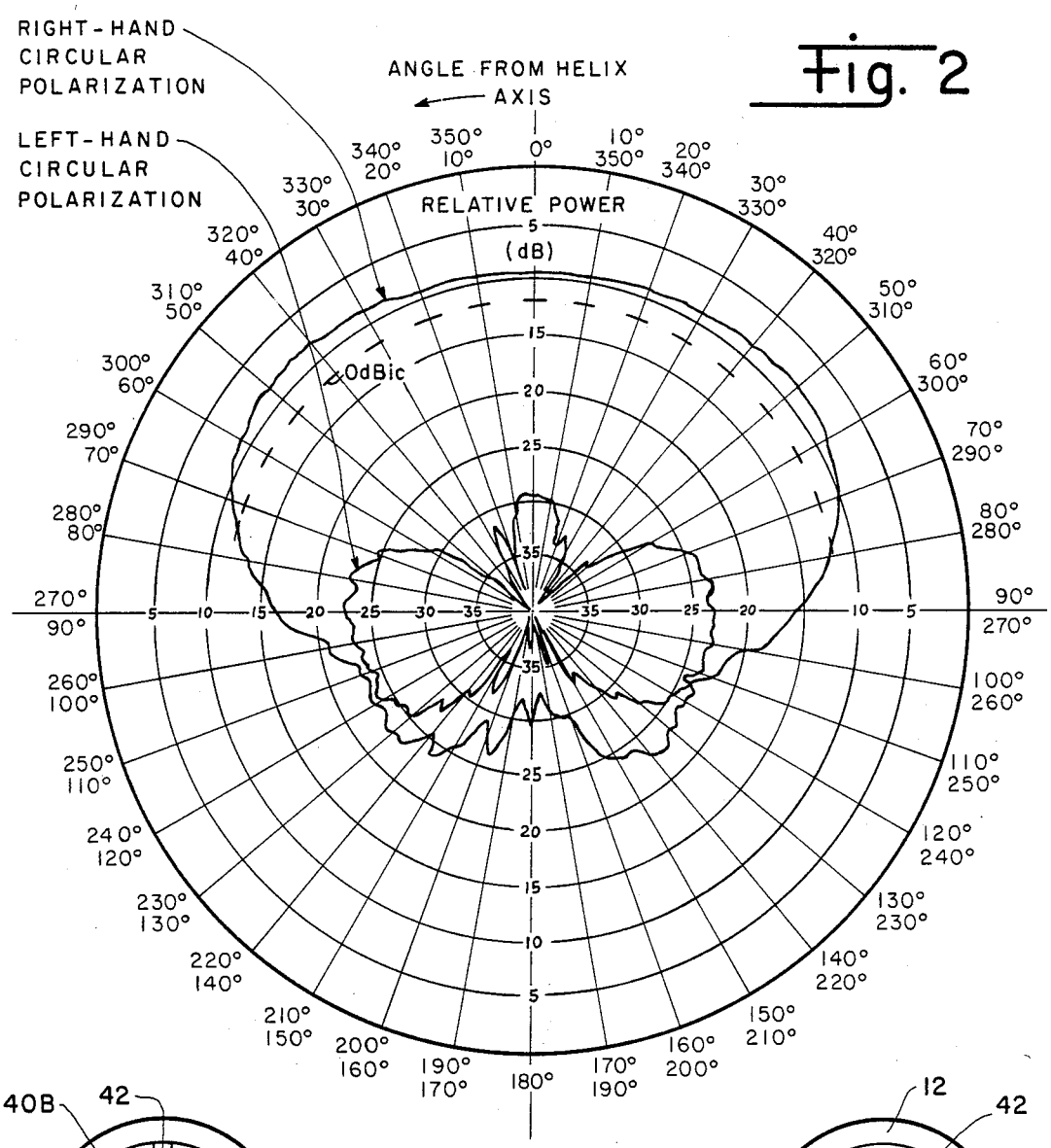
FIG. 2 shows a free space radiation pattern for the backfire bifilar helix antenna.

For radiating purposes, with proper choice of radius and pitch length, equal and opposite currents on the outer shields 22 of helixes 12 and 14 will induce a traveling wave which attenuates down the tubular member 16. The radiated wave will be primarily circularly polarized with its maximum intensity in the direction opposite to the traveling wave. FIG. 2 illustrates a free space radiation pattern for the antenna measured at 1575 MHz.

In a specific example of the invention, helixes 12 and 14 are wound on a tubular member 16 having an overall length of 8.1 inches and an outer diameter of 1.75 inches. Pitch as measured by the longitudinal distance of one complete revolution of helixes 12 and 14, is 2.7 inches. Tubular member 16 may be made of bakelite or alternatively of a suitable flexible material. The length of the tubular member 16 should be sufficient to attenuate the traveling wave at the bottom of the antenna to a low level. Shorting the bottom inner radials of helixes 12 and 14 by connecting the shields 22 of the helixes at the bottom of the tubular member 16 prevents the remnants of the wave from continuing onto the feed cable extending from the bottom of the tubular member (indicated at 12A). Connection may be made by soldering the shields 22 as indicated at 32 or by means of a coupling (not shown). The feed cable 12A extending from the bottom of the tubular member may be integral with the cable comprising helix 12, or may be connected thereto by a suitable connector (not shown).

Figure 3:
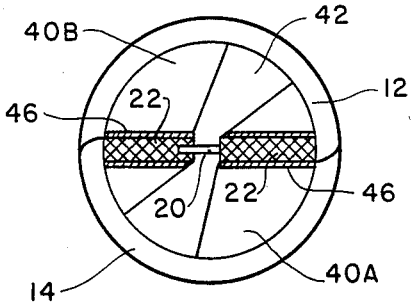
FIG. 3 is a top view of the antenna of FIG. 1 showing the infinite balun feed arrangement for the helical conductors, and the opposing conductive surface layer patterns used for impedance matching.

The nominal impedance of the backfire bifilar helix antenna may be adjusted to match the impedance of the transmission line (e.g. 50 ohms), by enlarging the conductor surface area of the shield portions 22 of helixes 12 and 14 at the feed point. According to the preferred embodiment of the invention, the conductor area is enlarged by attaching conductive surface layers 40A and 40B to the upper inner radials of helixes 12 and 14. The conductive surface layers 40A and 40B are preferably disposed on a disk 42 made of an insulative material such as fiberglass attached to the top of tubular member 16. Copper is a suitable material for the conductive surface layers 40A and 40B. As best seen in FIG. 3, the shields 22 of the feed ends of helixes 12 and 14 are connected by means of solder 46 or the like to the layers 40A and 40B. The input impedance is adjusted by trimming or photo etching the layers into predetermined pie-shaped patterns.

An empirical procedure has been developed to find a configuration for the conductor surface layers 40A and 40B which produces a good impedance match for a given helix geometry and operating frequency. The procedure utilizes test equipment to measure the return loss or voltage standing wave ratio (VSWR) of the antenna. A conventional network analyzer which continuously displays the return loss over a significant bandwidth, e.g., 1–2 GHz, is suitable for this purpose.

Figure 4:
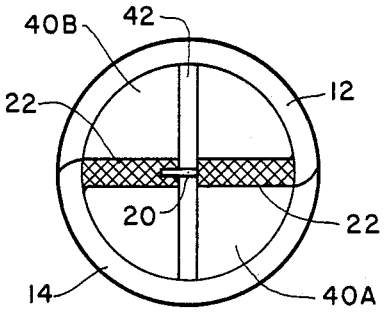
FIGS. 4 and 5 are top views of the antenna illustrating a procedure for obtaining an impedance match wherein the conductive surface layers are rotated with respect to the upper radials of the helixes.
Figure 5:
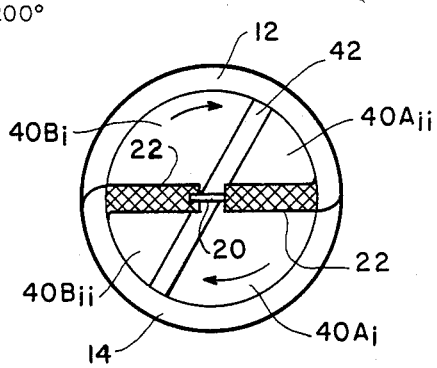

As shown in FIG. 4, conductive surface layers 40A and 40B initially are in the form of equal semicircular shapes displaced on disk 42 and separated from each other by a small distance. The disk 42 is loosely mounted on tubular member 16 with the upper inner radials of helixes 12 and 14 generally perpendicular to the diameter of the two semicircles. With the test equipment connected, the disk 42 is incrementally rotated relative to the helixes 12 and 14 as indicated in FIG. 5. At each increment, the helixes 12 and 14 are lightly soldered to the conductive surface layers 40A and 40B to establish electrical contact, and the antenna return loss is measured. The process is continued until the position giving the highest return loss at the desired frequency is determined.

Following the initial tuning stage wherein the relative position of the conductive surface layers is fixed with respect to the helixes, optimum impedance matching is obtained by trimming small segments of material from the conductive surface layers 40A and 40B. Referring again to FIG. 5, corresponding sections of the conductive surface layers, namely 40Ai, 40Bi, and 40Aii, 40Bii, are trimmed equally so that their respective shapes are kept the same. The return loss is monitored as the trimming operations are performed in an iterative manner. A VSWR of 1.1:1 on center frequency, with a VSWR of 2:1 (max) over a 30% bandwidth may be achieved using this procedure. A typical resultant configuration is shown in FIG. 3. Using copper cladding as the conductive material, the trimming operation may be accomplished by slicing small segments of the material with a knife or razor. If it would be necessary to replace or add conductive material to the conductive surface layers, thin strips of copper tape material soldered to the conductive surface layers may be used.

Once the final configuration of the conductive surface layers is determined, duplicate antennas can be manufactured without any individual tuning.

Thus while preferred features of the invention are embodied in the structure illustrated herein, it is understood that changes and variations may be made by those skilled in the art without departing from the spirit and scope of the invention. For instance, the size and shape of the conductive surface layers are not limited to what has been described but may vary provided they are maintained substantially equal.

We claim:

1. A backfire bifilar helix antenna having a pair of opposing spiral conductors for radiating or receiving a circularly polarized wave, comprising:

first and second coaxial cables helically wound in excess of one full turn in the same direction and having a predetermined radius and constant pitch, said coaxial cables having a center conductor and a shield conductor, the shield conductors of said cables forming said pair of opposing spiral conductors;

infinite balun feed means for coupling signals of equal magnitude and 180° out of phase to one end of said first and second coaxial cables, said feed means including a transmission line comprising the center conductor and the shield conductor of one of said coaxial cables, and wherein said center conductor of said transmission line is directly connected to the shield conductor of the other coaxial cable at said one end; and means for adjusting the input impedance of the antenna to a predetermined value, said least mentioned means including identical tuned conductive surface layers directly connected to the shield conductors of said first and second coaxial cables at said one end.

2. The backfire bifilar helix antenna of claim 1, wherein said first and second coaxial cables are wound on a tubular member.

3. The backfire bifilar helix antenna of claim 2, further including a disk made of insulative material attached to an end of said tubular member, said conductive surface layers being disposed on said data.

4. The backfire bifilar helix antenna of claim 1, wherein said signals of equal magnitude and 180° out of phase induce a traveling wave which is attenuated in a direction along said first and second coaxial cables away from said one end.

5. The backfire bifilar helix antenna of claim 4, wherein said first and second conductors are connected together at a second end, thereby preventing remnants of said traveling wave from continuing along said transmission line.

6. The backfire bifilar helix antenna of claim 1, wherein said opposing spiral conductors have a spiral length of approximately three full turns.

7. The backfire bifilar helix antenna of claim 1, wherein said identical tuned conductive surface layers are formed from larger surface layer configurations which have been trimmed in size and moved with respect to the shield conductors of said first and second coaxial cables in order to obtain the desired impedance match for the antenna.

8. A backfire bifilar helix antenna having a pair of opposing spiral conductors for radiating or receiving a circularly polarized wave, comprising:

first and second coaxial cables helically wound approximately three full turns in the same direction and having a predetermined radius and constant pitch, said coaxial cables having a center conductor and a shield conductor, the shield conductors of said cables forming said pair of opposing spiral conductors;

infinite balun feed means for coupling signals of equal magnitude and 180° out of phase to one end of said first and second coaxial cables, said feed means including a transmission line comprising the center conductor and the shield conductor of one of said coaxial cables, and wherein said center conductor of said transmission line is directly connected to the shield conductor of the other coaxial cable at said one end so as to induce a traveling wave which is attenuated to a low level in a direction away from said one end; and means for adjusting the input impedance of the antenna to a predetermined value, said last mentioned means including identical tuned conductive surface layers directly connected to the shield conductors of said first and second coaxial cables at said one end, wherein said identical tuned conductive surface layers are formed from larger surface layer configurations which have been trimmed in size and moved with respect to the shield conductors of said first and second coaxial cables in order to obtain the desired impedance match for the antenna.

* * * * *

UNITED STATES PATENT AND TRADEMARK OFFICE

CERTIFICATE OF CORRECTION

PATENT NO. : 4,608,574

DATED : August 26, 1986

INVENTOR(S) : Carson W. Webster et al

It is certified that error appears in the above-identified patent and that said Letters Patent is hereby corrected as shown below:

At claim 3, line 4, "data" should read ---disk---.

Signed and Sealed this

Sixteenth Day of December, 1986

*Attest:*

DONALD J. QUIGG

*Attesting Officer*

*Commissioner of Patents and Trademarks*